US006109172A

United States Patent [19]

Wyssmann

[11] Patent Number: 6,109,172

[45] Date of Patent: Aug. 29, 2000

[54] SILK-SCREEN PRINTING MACHINE

[75] Inventor: Hans Wyssmann, Zurich, Switzerland

[73] Assignee: De La Rue Giori S.A., Lausanne, Switzerland

[21] Appl. No.: 09/142,730

[22] PCT Filed: Mar. 19, 1997

[86] PCT No.: PCT/CH97/00115

§ 371 Date: Sep. 14, 1998

§ 102(e) Date: Sep. 14, 1998

[87] PCT Pub. No.: WO97/34767

PCT Pub. Date: Sep. 25, 1997

[30] Foreign Application Priority Data

Mar. 21, 1996 [CH] Switzerland ..... 732/96

[51] Int. Cl.[7] ..... B41F 15/04

[52] U.S. Cl. ..... 101/115; 101/116

[58] Field of Search ..... 101/114, 115, 101/116, 117, 118, 119, 120, 129, 171, 183, 184

[56] References Cited

U.S. PATENT DOCUMENTS 2,445,140 7/1948 Hanington .
3,934,502 1/1976 Marino .
3,990,363 11/1976 Vertegaal .
5,247,882 9/1993 Zook et al. .

FOREIGN PATENT DOCUMENTS 0 095 819 12/1983 European Pat. Off. .
0 723 864 A1 7/1996 European Pat. Off. .
822 540 11/1951 Germany .
310 226 12/1955 Switzerland .

*Primary Examiner*—Ren Yan
*Attorney, Agent, or Firm*—Pitney, Hardin, Kipp & Szuch LLP

[57] ABSTRACT

A machine including a printing cylinder (6) engaging two stencil cylinders (7, 18) for printing at least two non-overlapping areas in different colors using the one printing cylinder. One of the stencil cylinders (7) is conventional and enables silk-screen printing in a first area. The other cylinder (18) includes raised portions provided with a stencil for printing one or more further areas different from the first area while preventing the rest of the stencil cylinder (18) from contacting the printing cylinder and particularly the area(s) printed by the first cylinder (7).

13 Claims, 8 Drawing Sheets

SILK-SCREEN PRINTING MACHINE

FIELD OF THE INVENTION

The present invention relates to a screen printing machine comprising, for printing at least one first area in a defined color, an impression cylinder and a screen cylinder, and at least one second screen cylinder interacting with the same impression cylinder and being provided with means for printing at least one second area in a different color from that of the first area.

PRIOR ART

The use of screen printing machines comprising an impression cylinder and a screen cylinder for printing an area of a defined color is known. When it is desired to print juxtaposed or superimposed areas of another color, the first printing is dried and then the paper runs through a second machine comprising an impression cylinder and a screen cylinder for superimposed or juxtaposed printing of the second image in a color different from the first. Therefore in multicolor printing, there is one pass for each color after the ink of the previous printing has dried.

U.S. Pat. No. 3,934,502 discloses a screen printing machine comprising an impression cylinder and at least two screen cylinders interacting with the impression cylinder for the printing of at least two areas, each area being in a different color from that of the other.

U.S. Pat. No. 3,990,363 discloses a similar machine as the previous excepted that the printed areas are not superimposed and the second screen cylinder does not come into contact with the impression cylinder on the area printed by the screen cylinder.

With the concern to find means making security papers difficult to copy or counterfeit, various types of printing have been used on the same security paper including, inter alia, screen printing. Nevertheless, the printing of the various designs using different processes, and the intermediate drying which must take place, lengthen the time for printing the documents and problems of registration between the various printings make these printing operations tricky and increase the costs by the addition of equipment.

SUMMARY OF THE INVENTION

The object of the present invention is to provide a machine for the screen printing of certain areas of a paper with at least two non-superimposed designs of different colors without having to run through an intermediate drying unit and using a relatively simple machine which is less voluminous than a multicolor screen printing plant used hitherto.

The screen printing machine according to the invention is organized so that the said second area is outside the first area, the second screen cylinder comprising at least one raised part on which a screen is arranged so the second screen cylinder does not come into contact with the impression cylinder on the area(s) printed by the first screen cylinder.

The advantages of the machine according to the invention are as follows:

printing in a single pass of the paper on a single impression cylinder of at least two non-superimposed areas in at least two different colors, which, on the one hand, makes intermediate drying between the two printings unnecessary and, on the other hand, results in a less voluminous machine, since only a single impression cylinder is used, and therefore a less expensive machine;

additionally, it is easier to obtain good registration between the screen printing images printed in succession by means of the same impression cylinder.

These results are, of course, obtained by virtue of the fact that the second area is printed by a screen cylinder provided with means for printing at least one second area of the paper which is not yet printed and does not touch the area already printed by the first screen cylinder. The means with which the second screen cylinder is provided comprise at least one raised part on which a screen is arranged. Thus, it is only the raised part or parts which come into contact with the impression cylinder on areas not printed by the first screen cylinder. Devices pushing the ink through the screen are provided inside the screen cylinder, these devices being preferably, but not exclusively, squeegees. The latter may be a conventional screen cylinder or, for example, like the one proposed in the applicant's European patent application No. 0723864. By avoiding the second screen cylinder touching the areas already printed during the first pass, it is not necessary to carry out intermediate drying. It is clear that, in such printing, it is necessary to maintain a sufficient spacing between the two areas in order to avoid the screen of the second screen cylinder coming into contact with the previously printed area.

According to a preferred variant of the invention, the screen of the first cylinder is designed to print several spaced-apart areas in a defined color (the design could be the same or different for each area) and the second cylinder also has several raised areas enabling the same design or several designs to be printed in a second color in spaces left by the previous printing.

According to another embodiment variant, the machine may comprise several screen cylinders with raised means in order to print, in succession and by means of a single impression cylinder, non-superimposed areas of different colors, the raised features of the various cylinders being arranged so that they do not come into contact during printing with the areas printed previously.

According to one embodiment, the raised areas of the screen cylinder or of each of the screen cylinders have an axial shape extending parallel to the axis of the cylinder, along that surface of the latter on which the screen is arranged. In this case, the squeegee, or the equivalent device, is provided with a mechanism enabling the squeegee to move radially in order to be able to follow the configuration of the internal side of the periphery of the cylinder, so as to push the screen arranged on the raised part of the cylinder and to be retracted when, by rotation of the cylinder, the set-back part comes against the squeegee, and so on.

According to one embodiment, the mechanism enabling the squeegee to perform these movements in the radial direction is a cam rotating in synchronism with the screen cylinder and acting on the end of a lever whose other end is fastened to the squeegee.

According to another embodiment, the raised parts are annular areas on which the screen is applied and in this case the squeegee has the shape of a comb whose teeth always lie within the annular areas in order to push the ink through the screen in which these annular areas are equipped.

According to another embodiment variant, the second screen cylinder is provided with an elastically deformable screen so that contact with the impression cylinder in line with the impression slot takes place only under the thrust of the means such as a squeegee having in this case the shape of a comb, whose teeth correspond to the areas to be printed, pushing the screen so as to come into contact with the impression cylinder, the space between the teeth corresponding to printed or non-printed areas and with which the screen does not come into contact. Further, the screen is provided with spaced-apart rings with corresponding spaces between two successive areas to be printed, preventing the screen from deforming and from coming into contact with the impression cylinder.

According to another embodiment variant, the machine is a sheet-fed printing machine comprising an impression cylinder with at least one notch housing the device for seizing the sheet, and the ink-pushing means of each screen cylinder comprise a mechanism enabling them to move away from the screen when a notch passes into the impression slot.

BRIEF DESCRIPTION OF THE DRAWINGS

The invention will be described in more detail by means of four examples of a sheet-fed printing machine and with the aid of the appended drawing.

DESCRIPTION OF THE PREFERRED EMBODIMENTS

Figure 1:
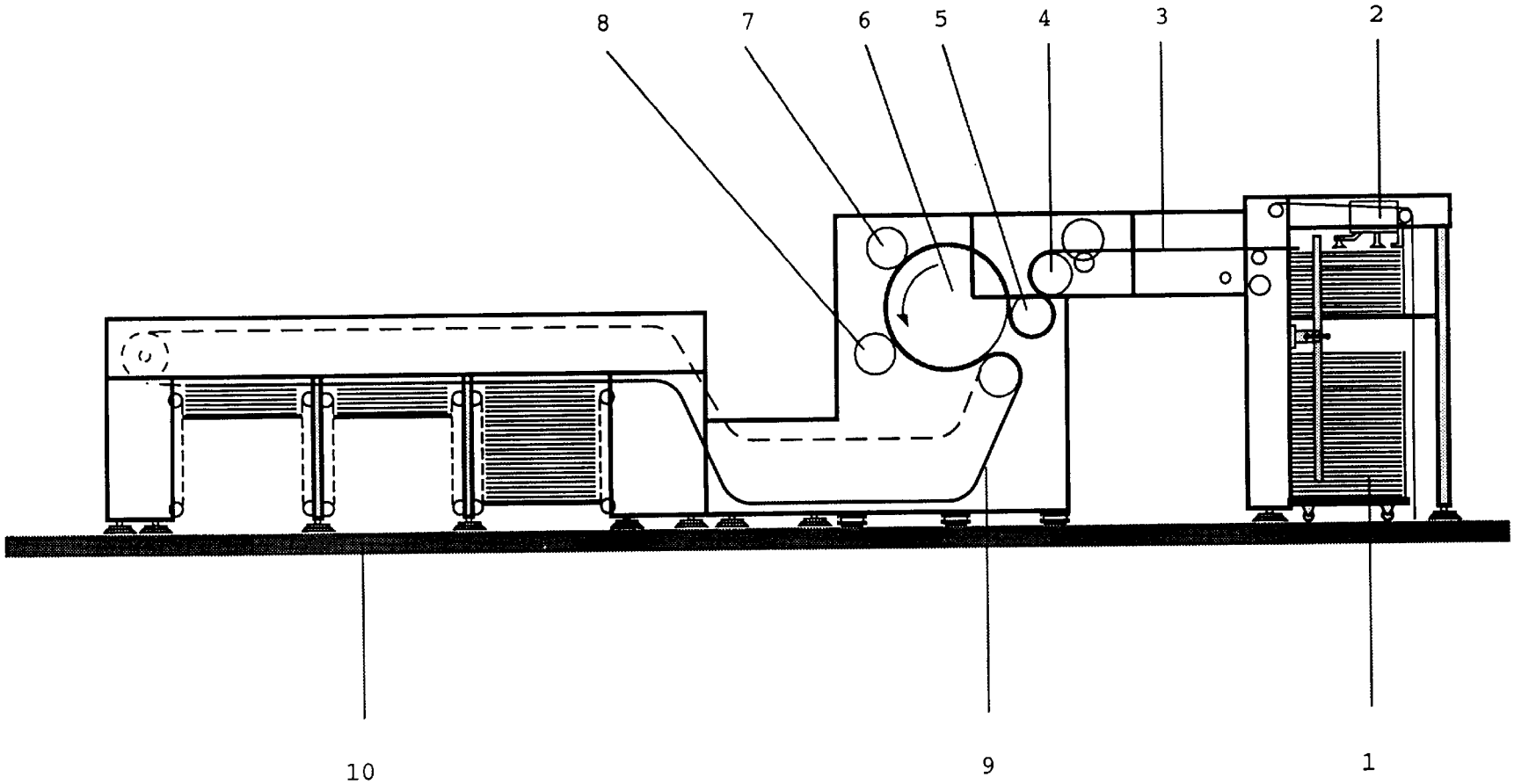
FIG. 1 is a lateral diagrammatic representation of a plant comprising a machine forming the subject of the present invention.

FIG. 1 shows a complete plant comprising a machine for screen printing in two different colors, according to the invention. The plant has a magazine 1 containing the sheets to be printed, a feeder device 2 for transferring the sheets along the path 3 to a feed roller 4, a transfer roller 5 for conveying the sheets of paper to a single impression cylinder 6, two screen cylinders 7 and 8 interacting with the impression cylinder 6 and a chain-type gripper system 9 which transports the sheets to the sheet output magazines 10 comprising, in the present case, three stacks.

On the impression cylinder 6, which rotates clockwise, the sheets first pass the first screen cylinder 7, where they are partially printed in a first color, and then they pass the second screen cylinder 8, where they are printed in a different color in at least one non-superimposed area, therefore an area outside the areas printed by the first screen cylinder 7, without prior drying of the areas printed by the cylinder 7 being necessary.

With regard to the operation of the screen cylinders, the printing takes place by conventional means, that is to say that the ink is introduced into each of the screen cylinders and, during rotation of the cylinder, it flows inside and is pushed by a corresponding squeegee, or an equivalent device, in order to pass through the screen representing the design to be printed.

The abovementioned offset of the areas of different color is obtained by the fact that the screen cylinder 8 presents at least one raised part on which a screen is arranged enabling the second area to be printed, the combination being positioned and sized so that the raised part(s) of the screen cylinder 8 do not come into contact with the areas printed by the cylinder 7, this being of a construction like the one already proposed by the applicant.

The second screen cylinder 8 according to the present invention may be made according to four different constructions, as represented in the following figures: this second screen cylinder carries, according to the first embodiment, the reference 18, according to the second embodiment, the reference 28, according to the third embodiment, the reference 48 and according to the fourth embodiment, the reference 48'.

Figure 3:
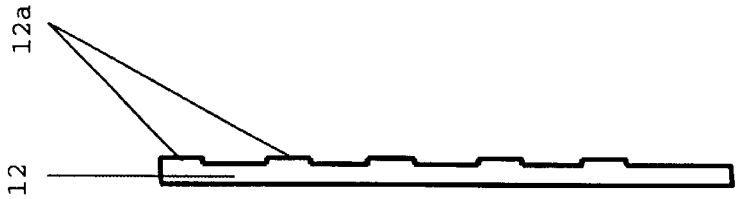
FIG. 3 is a side view of the squeegee used in the screen cylinder of the first embodiment according to FIG. 2.
Figure 2:
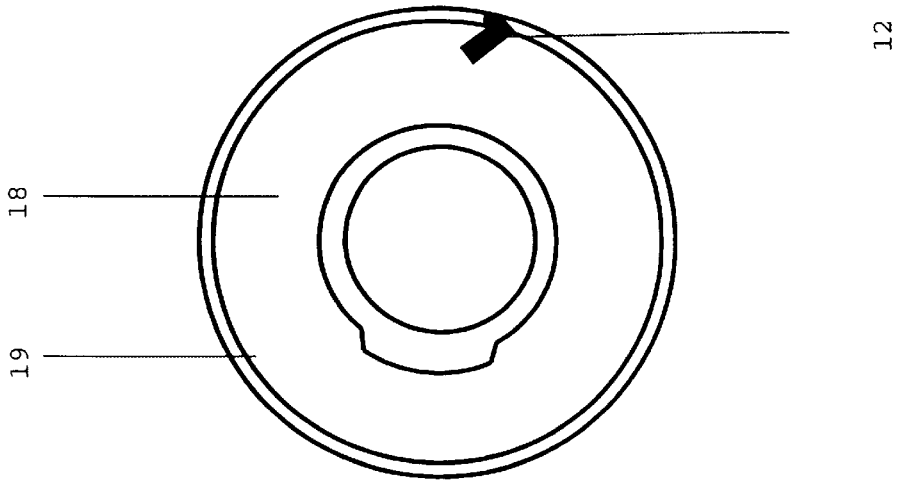
FIG. 2 is a diagrammatic side view of a first embodiment of a screen cylinder presenting raised parts having the shape of rings concentric with the cylinder.
Figure 8:
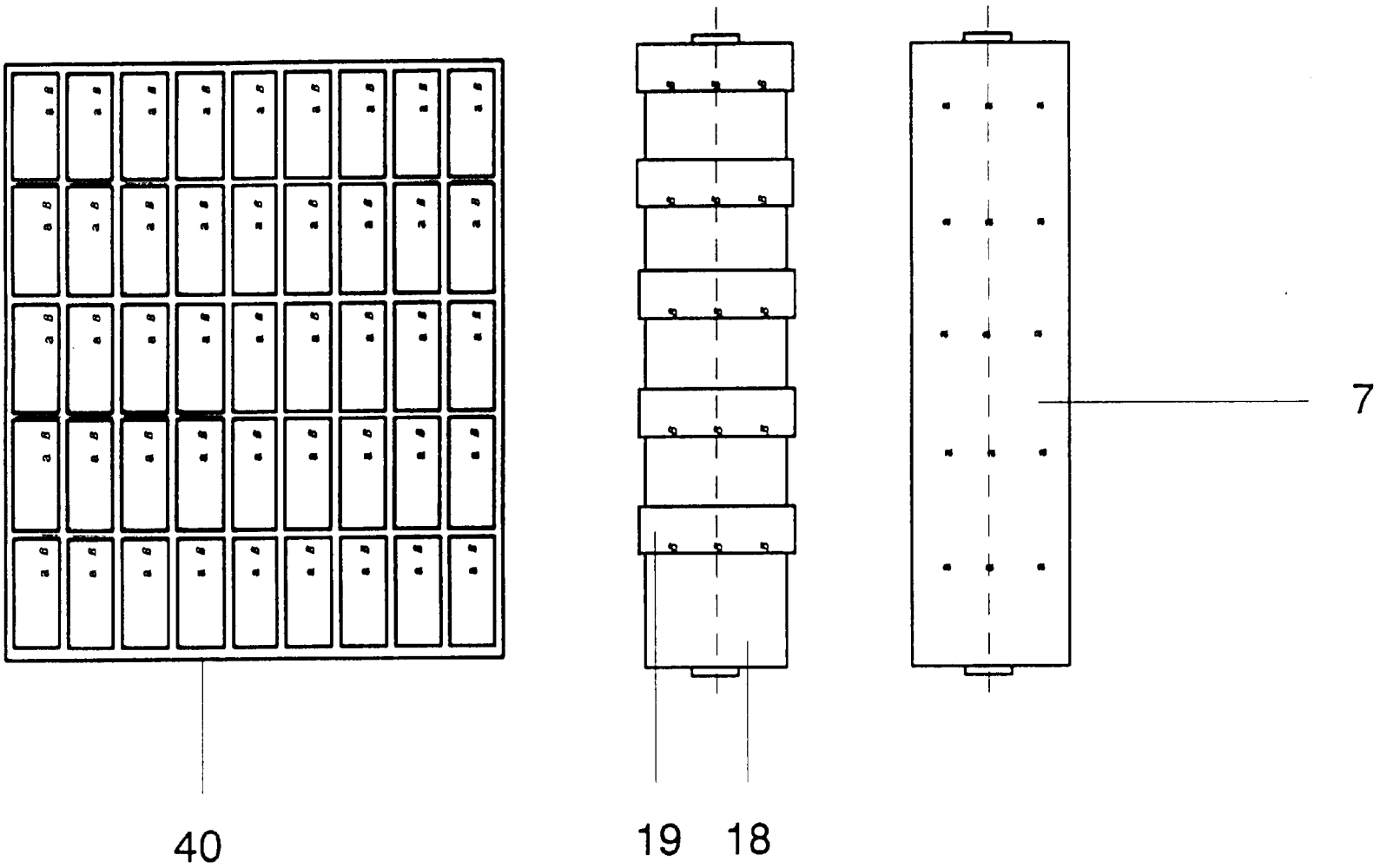
FIG. 8 is a diagrammatic overall view enabling the operation of the first embodiment according to FIGS. 2, 3 and 6 to be explained.

FIG. 2 shows, according to the first embodiment, a screen cylinder 18 provided with raised parts 19 which have the shape of rings concentric with the cylinder 18, these being arranged so as to spaced apart axially, as shown more clearly in FIG. 8. Inside this screen cylinder 18 is fitted a squeegee 12, as illustrated in FIG. 3, the front edge of which is adapted to the shape of the internal periphery of the screen cylinder 18, and therefore has the shape of a comb whose teeth 12*a* correspond, in terms of both size and arrangement, to the annular raised parts 19 in order to push the ink, during printing, through the screen covering the raised parts 19.

Figure 5:
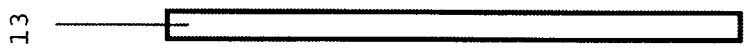
FIG. 5 is a side view of the squeegee used in the screen cylinder of the second embodiment according to FIG. 4.
Figure 4:
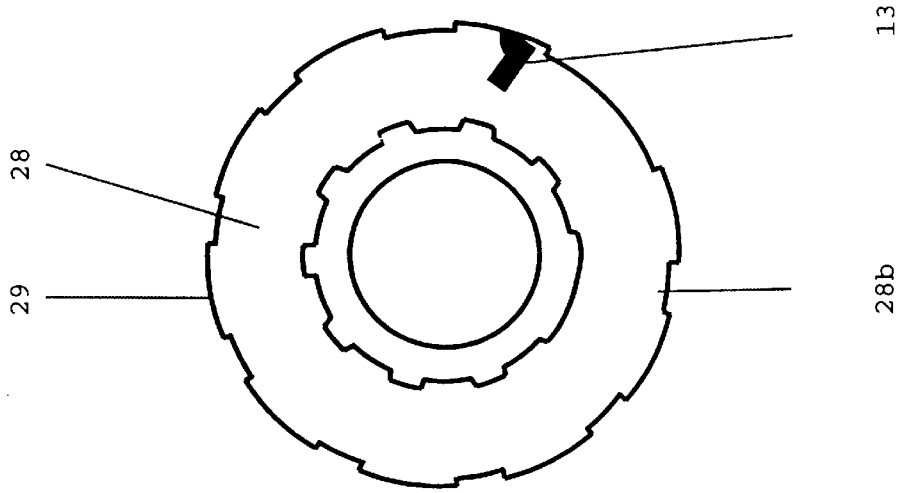
FIG. 4 is a diagrammatic side view of a second embodiment of the screen cylinder presenting raised parts having the shape of axial areas.
Figure 9:
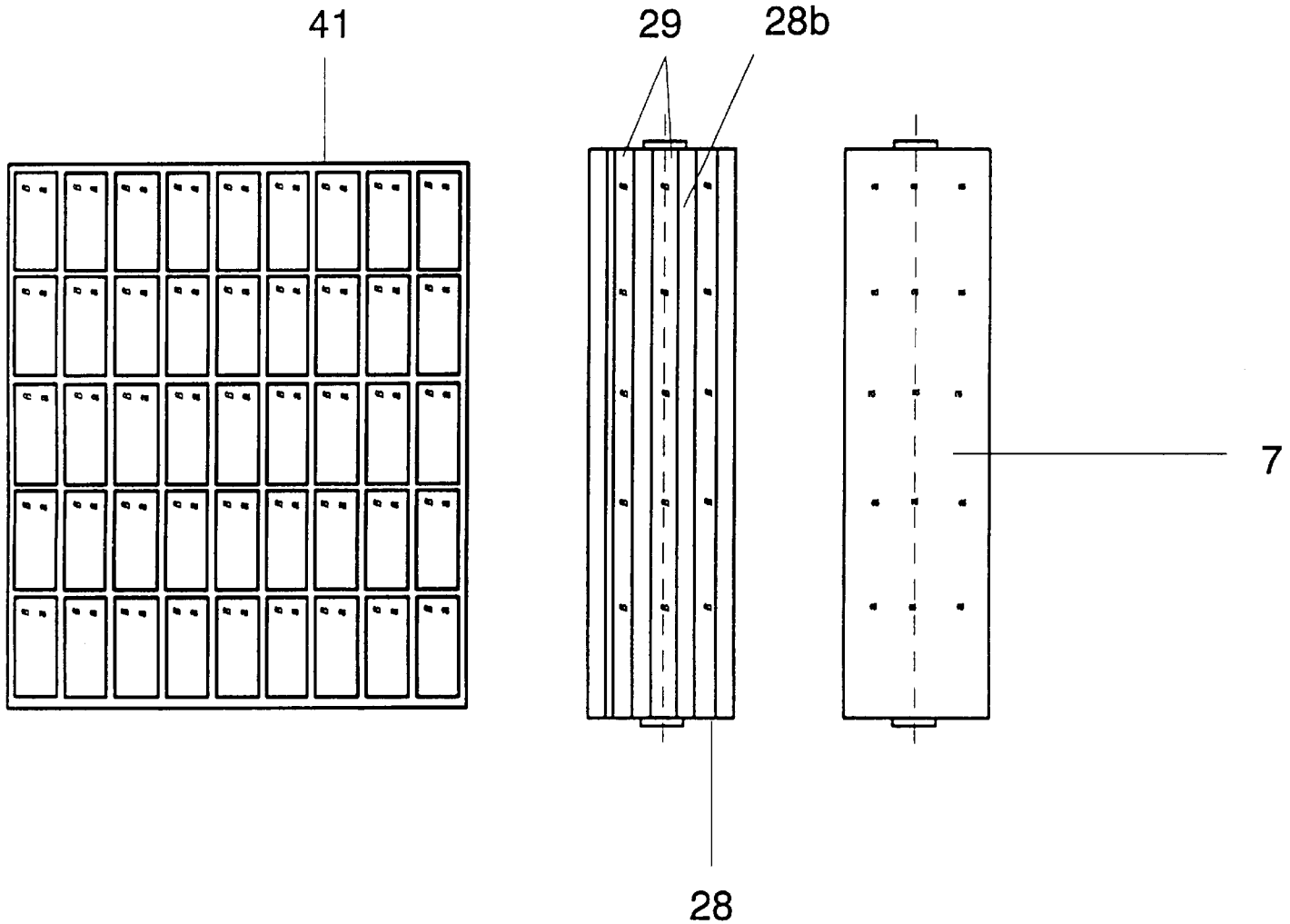
FIG. 9 is a representation similar to that in FIG. 8, in order to explain the operation of the second embodiment according to FIGS. 4, 5 and 7.
Figure 11:
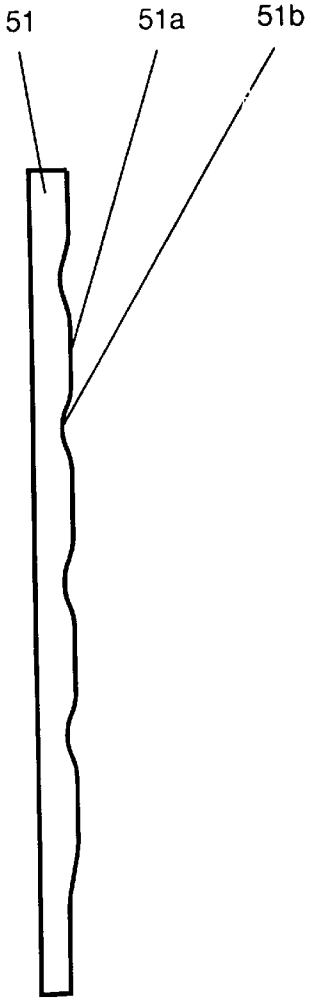
FIG. 11 is a side view of the squeegee used with the screen cylinder in FIG. 10.

The screen cylinder 28 according to the second embodiment, as represented in FIGS. 4 and 9, is provided with raised parts in the form of axial areas 29 which are spaced apart and extend over the entire length of the cylinder and on which a screen is arranged. The squeegee 13 mounted inside this cylinder 28 is a conventional squeegee, as shown in FIG. 5, the front edge of which is straight. Because of the axial raised areas of the cylinder 28, this squeegee 13 is provided with a device enabling it to be retracted as the cylinder 28 rotates in order to pass the set-back parts between the raised areas 29.

Figure 6:
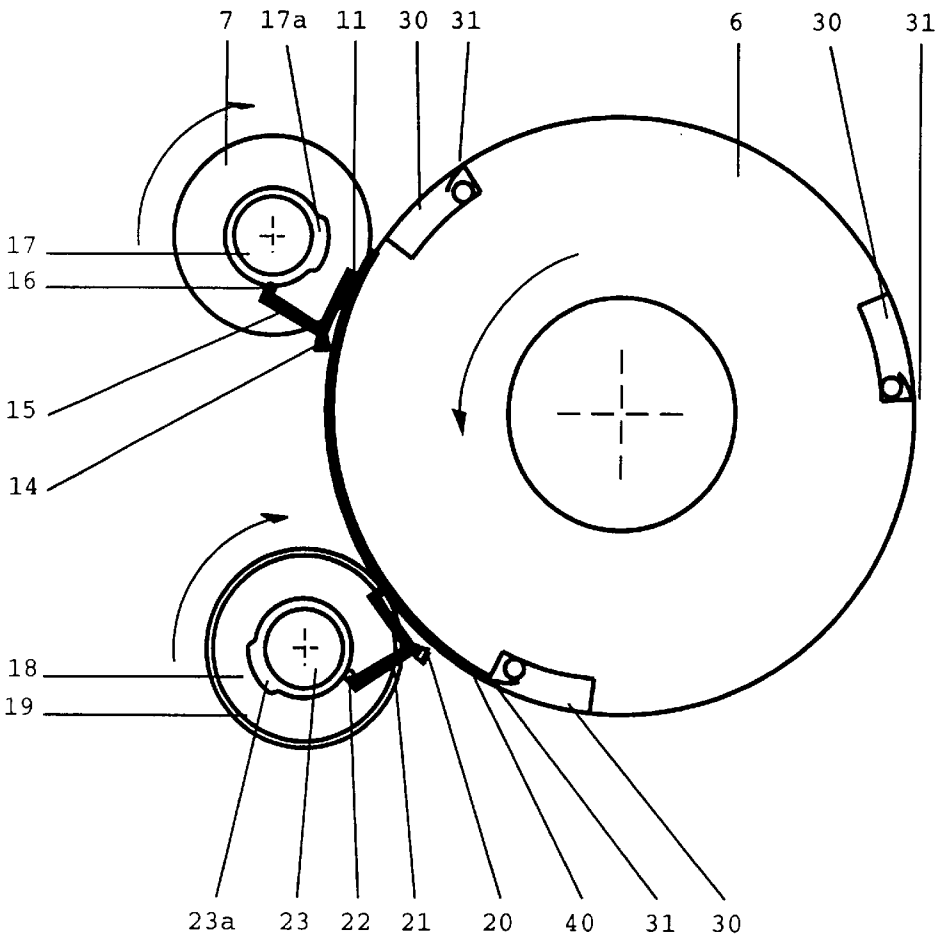
FIG. 6 shows the combination of the impression cylinder and the two screen cylinders, according to a first embodiment.

In order to understand the first embodiment more clearly, reference is made to FIGS. 6 and 8 in which have been diagrammatically represented the two screen cylinders 7 and 18 as well as a printed sheet of paper 40 which, in FIG. 8, is shown opened out. In the present case, the diameter of the screen cylinder 7 and 18 is equal to one third of the diameter of the impression cylinder 6, the surface area of which corresponds to three sheets. A sheet 40 is shown in FIG. 8 and includes 5×9=45 impressions of bank bills, arranged in transverse and longitudinal rows, to which must be added two areas of different color, namely, in the case in question, the first area consisting of the character "a" and the second area consisting of the character "B".

For this purpose, the machine according to FIG. 6 comprises the impression cylinder 6 provided with three rows of grippers 31 housed in notches 30, said grippers 31 being intended to hold the leading end of a sheet 40 which comes from the transfer roller 5 (FIG. 1) in order to run it past the two screen cylinders 7 and 18. The screen cylinder 7 is of the type proposed in Swiss Patent Application CH 192/95-0 and enables the character "a" to be conventionally printed in a defined color on each bank bill impression. This cylinder 7 is provided on its axis with a cam 17 rotating with it and acting on a lever in the shape of an angle bracket 15, one of the ends of which is provided with a roller 16 corresponding with the cam 17, this angle bracket being under the action of a spring, not shown, which pushes it radially outward toward the screen. The vertex of the angle of the angle bracket 15 is articulated to a fixed point 14, while the other end of the lever is fastened to the squeegee 11. The purpose of this cam 17 (as described in said Swiss Patent Application CH 192/95-0) is to move the squeegee 11 away from the inside of the screen, against the action of said spring, when the projecting part 17*a* of the cam 17 comes into contact with the roller 16 of the angle bracket 15. This takes place while one of the notches 30 in the impression cylinder 6 passes the impression slot between the cylinders 6 and 7, therefore comes opposite the position of the squeegee 11. If the squeegee 11 were not moved away, this would have the effect of damaging the screen since, at this point, the impression cylinder 6 would not present a surface against which the screen of the cylinder 7 would bear under the pressure of the squeegee 11.

It is clear that the squeegee could be driven by other means, especially a hydraulic or pneumatic actuator controlled by an electronic device, an electromechanical device, etc.

Thereafter, the paper 40 runs past the second screen cylinder 18 for printing the second area consisting of the character "B". This cylinder 18 is provided with annular raised parts 19 over each of which is stretched a screen with the design to be printed, in this case the letter "B". It will be noted that the raised parts 19 of the cylinder 18 are offset laterally with respect to the areas of printing by the cylinder 7, comprising the letter "a". Thus, as the sheet 40 passes between the cylinders 6 and 18, the areas already printed by the cylinder 7 do not come into contact with the cylinder 18 since these areas, containing the "a"s, are opposite the set-back spaces between two annular areas 19. Thus, the printing can take place in a single pass by means of the same impression cylinder and without waiting for the areas printed by the cylinder 7 to be dried beforehand.

This arrangement of the annular areas allows printing of the areas which are offset perpendicularly to the direction of movement of the paper 40.

Inside the screen cylinder 18 is the squeegee 12, as illustrated in FIG. 3, in the shape of a comb with teeth 12*a*; this squeegee 12 is mounted, as in the case of the first screen cylinder 7, at one end of an angle bracket 21 articulated at its vertex about a fixed pin 20 and carrying, at its other end, a roller 22 which is in permanent contact with the surface of a cam 23 provided with a projecting part 23*a*. This cam 23 therefore has the same configuration of the cam 17 of the cylinder 7 and acts for the same purpose, namely to move the squeegee 12 back from the internal side of the screen while one of the notches 30 in the impression cylinder 6 is passing in front of the impression slot.

Figure 7:
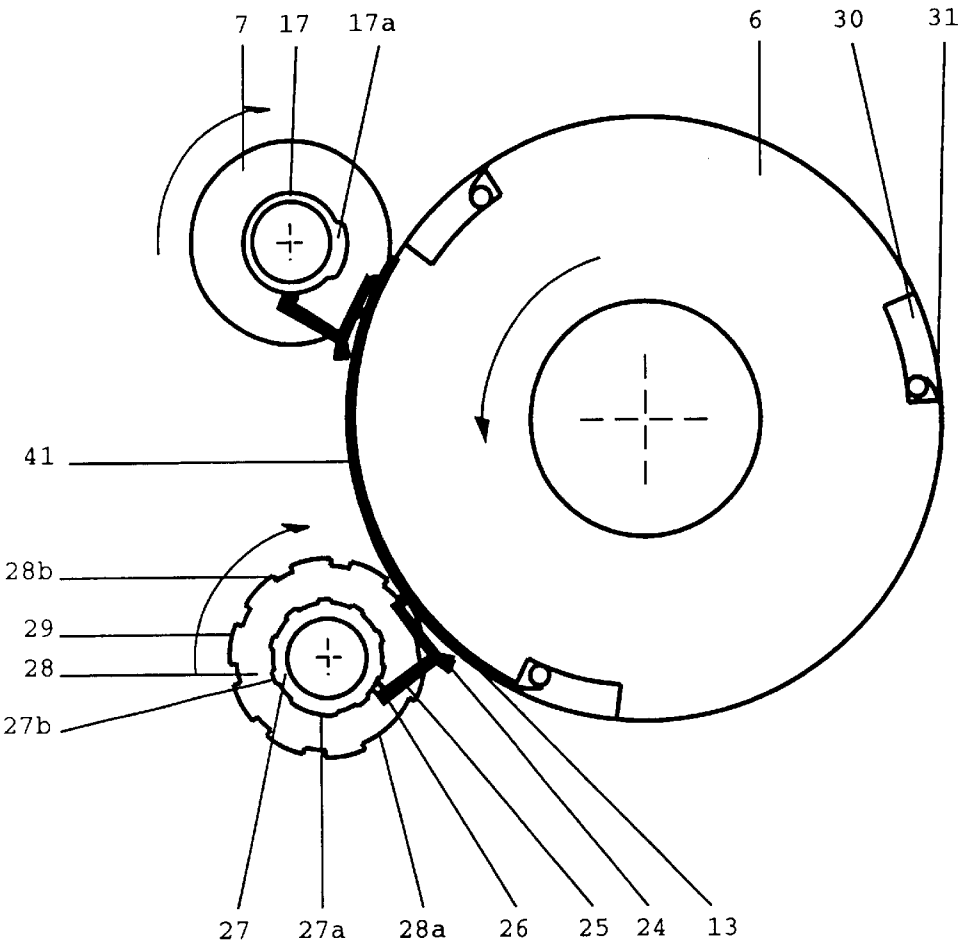
FIG. 7 is a representation similar to that in FIG. 6, according to a second embodiment.

The second embodiment according to FIGS. 7 and 9 allows printing of the areas, in the form of characters "a" and "B", offset in the direction of movement of the sheets of paper 41 which once again include 5×9 impressions of bills. The screen cylinder 7, with its squeegee, its angle bracket and the cam 17, 17*a*, is identical to that in FIG. 6 and prints the first areas with the letter "a"; the impression cylinder 6 also has the same construction as that described in relation to FIG. 6.

The second screen cylinder 28, which includes axial raised areas 29 extending over its entire length, is provided with a screen on each of the raised parts 29 for printing the letter "B" in another color than the letter "a". This printing is, as may be seen in the sheet 41 (FIG. 9), printed offset in the direction of movement of the paper. The squeegee 13 is controlled by a cam 27 fixed to the spindle of the cylinder 28 and rotating in synchronism with the latter. This squeegee 13 is fixed to one end of an angle bracket 25 articulated at its vertex to a fixed pin 24 and provided at its other end with a roller 26 in permanent contact with a cam 27. The shape of this cam 27 reproduces, on a smaller scale, the profile of the screen cylinder 28, in negative, in order to enable the squeegee 13 to be guided inside said cylinder 28 so that the squeegee 13 follows the internal configuration of the periphery of the cylinder 28. Provided on the periphery of this cam 27 is a projecting part 27*a*, corresponding to the non-raised part 28*a* of the cylinder 28, adapted to a notch 30 in the impression cylinder 6, and pushing the impression slot always simultaneously with one of these notches 30, in order to withdraw the squeegee 13 during passage thereof. The remainder of the periphery of this cam includes projecting parts 27*b* which correspond to the parts 28*b* lying between the raised parts 29 of the cylinder 28.

Figure 10:
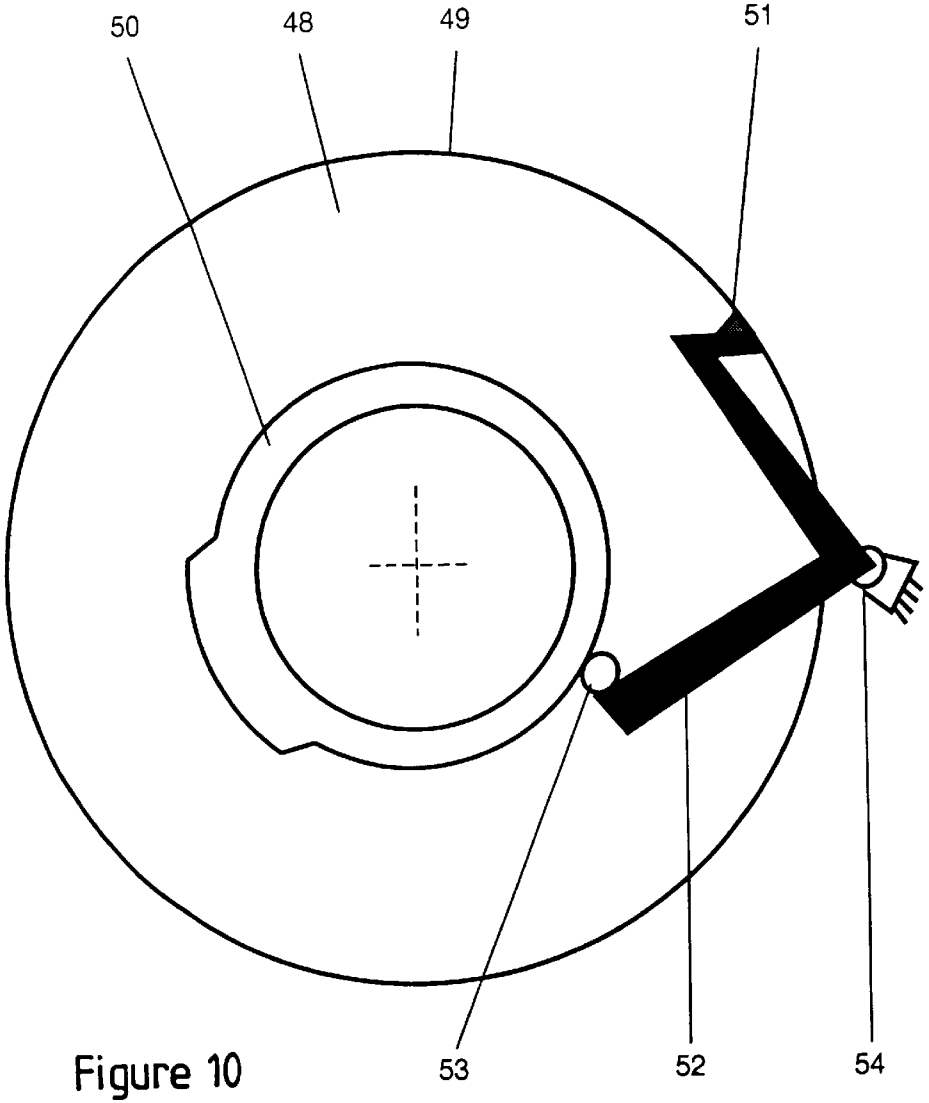
FIG. 10 is a diagrammatic side view of a third embodiment of the screen cylinder.

FIG. 10 shows the third embodiment, a screen cylinder 48 provided with a screen 49 which may be elastically deformed. Arranged inside this cylinder 48 is a squeegee 51 fastened to an angle bracket 52, one end of which is provided with a guide roller 53 interacting with a cam 50 driven in synchronous rotation with the cylinder 48. The angle bracket 52 is subjected to the action of a spring pushing the cam 51 radially against the screen 49. The vertex of the angle bracket 52 is articulated to a fixed point 54. The purpose of the cam 50 is to guide the squeegee 51, as for the first screen cylinder 7, so that it is moved away from the impression slot when a notch 30 in the impression cylinder 6 lies in the impression slot.

For this third embodiment, the screen cylinder 48 does not present a raised part, but the raised parts are created in the impression slot by the interaction of the front edge of the squeegee 51 which has the teeth 51*a* and the possibility of deforming the screen 49 elastically. Thus, areas which are in contact with the impression cylinder 6 are those areas of the screen 49 which are under the pressure of the teeth 51*a* of the squeegee 51. The set-back parts 51*b* of the squeegee correspond to the areas printed by the cylinder 7 or the areas which it is desired not to print, the screen 49 in these areas not coming into contact with the impression cylinder 6. It is clearly indispensable that the screen 49 does not come into contact with the areas already printed since the ink has not had the time to dry and the dimensions of these areas 51*b* of the squeegee are provided accordingly.

Figure 12:
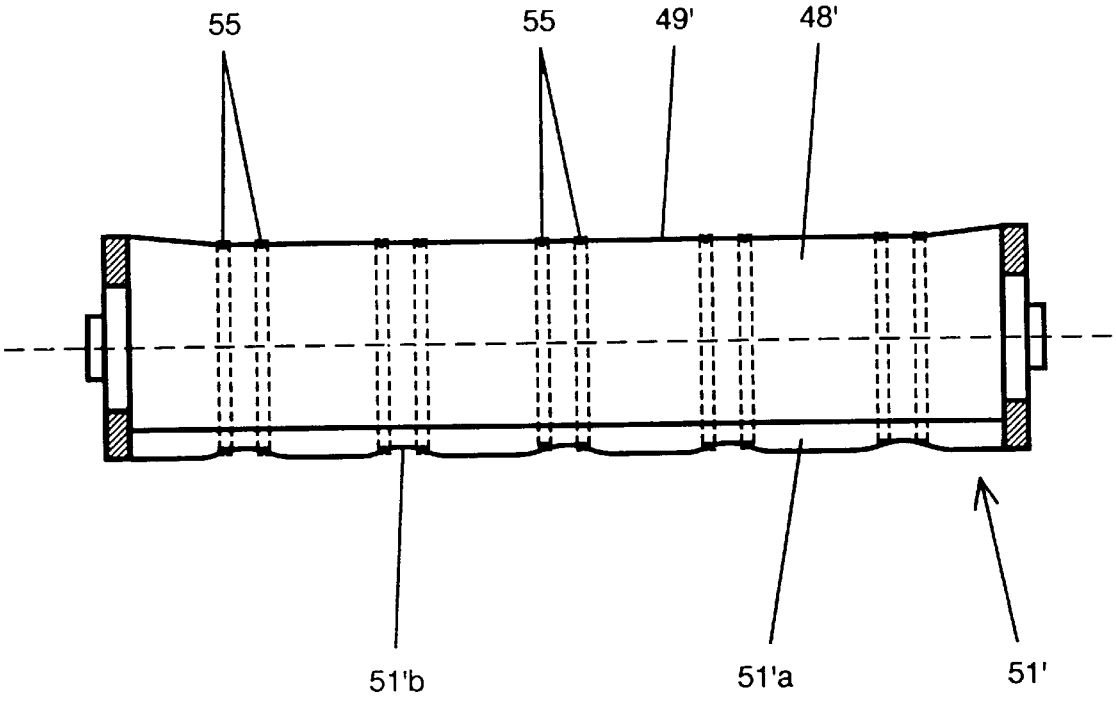
FIG. 12 is an axial sectional view of a screen cylinder of a fourth embodiment of the screen cylinder.

Finally, we have shown in FIG. 12 a variant of the third embodiment represented in FIG. 10.

The screen cylinder 48' is provided between two consecutive printing areas with two spaced-apart rings 55. It might be sufficient to have only a single ring per space, depending on the width of the area which it is desired not to bring into contact with the compression cylinder. The role of these rings is to ensure that the screen under the thrust of the squeegee 51' will not come, over parts, into contact with the impression cylinder. For this purpose, the rings 55 have a diameter less than the diameter enabling the screen 49' to be brought into contact with the impression cylinder. The rings 55 are preferably located at the ends of the areas which have not to come into contact with the impression cylinder. The rings 55 are preferably, but not exclusively, arranged on the external surface of the screen.

The invention is not limited to the embodiments which have just been described, and other variants could be envisaged, especially with regard to the configuration of the raised parts of the second screen cylinder, as well as the means for moving the squeegees radially inside these cylinders. Furthermore, the invention also relates to reel-fed printing machines.

It is also possible to provide more than two screen cylinders, with parts in contact with the impression cylinder which are offset with respect both to the areas printed by the cylinder 7 and those printed by the cylinder 8 or 28 or 48 or 48', and as long as the dimensions and the placement of said cylinders so allow, to have the possibility of printing more than two non-superimposed areas in different colors with a single impression cylinder.

Furthermore, the machine forming the subject of the present invention may be adapted to any similar plant or to the interior of a printing line comprising other standard printing machines for security papers, such as offset, intaglio, Orloff, etc.

What is claimed is:

1. A screen printing machine comprising, for printing at least one first area in a defined color, an impression cylinder (6) and a screen cylinder (7), and at least one second screen cylinder (8; 18; 28), interacting with the same impression cylinder (6) and being provided with means (19; 29) for printing at least one second area in a different color from that of the first area, wherein the machine is organized so that the said second area is outside the first area, the second screen cylinder comprising at least one raised part (19; 29) on which a screen is arranged so that the second screen cylinder (8; 18; 28) does not come into contact with the impression cylinder (6) on the area(s) printed by the first screen cylinder (7).

2. The machine as claimed in claim 1, wherein the first screen cylinder (7) is equipped with a screen for printing several spaced-apart areas and wherein the second screen cylinder (8; 18; 28) has several raised parts (19; 29) for printing the areas not printed by the first screen cylinder (7).

3. The machine as claimed in claim 1, wherein the raised part of the second screen cylinder (18) are annular areas (19).

4. The machine as claimed in claim 3, wherein said ink-pushing means (12) of the second screen cylinder (18) are designed so that they engage only the annular raised areas (19) and are preferably formed by a squeegee (12) which has the shape of a comb whose teeth **(12*a*) enter the annular areas of said screen cylinder (18)**.

5. The machine as claimed in claim 1, wherein the raised part of the second screen cylinder (28) are axial areas (29).

6. The machine as claimed in claim 1, wherein the screen cylinders (7; 18; 28) are provided on their inside with means (11; 12; 13) for pushing the ink against the internal side of the screen.

7. The machine as claimed in claim 6, wherein said ink-pushing means (13) of the second screen cylinder (28) are provided with a mechanism (25, 27) in order to be moved radially in such a manner that they follow the configuration of the internal periphery of the screen cylinder (28).

8. The machine as claimed in claim 7, wherein said mechanism comprises a cam (27) designed to be rotated in synchronism with the screen cylinder (28) acting on a lever (25) fastened to the squeegee (13).

9. The machine as claimed in claim 6, said machine being a sheet-fed printing machine wherein said impression cylinder includes at least one notch (30), wherein said ink-pushing means of each screen cylinder (7, 18, 28, 48, 48') comprises a mechanism (17, 15; 23, 21; 27, 25; 50, 52) enabling them to move away from the screen when a notch passes into an impression slot.

10. The machine as claimed in claim 1, which comprises other screen cylinders for printing other areas not overlapping the above previously printed areas, each in a different color, wherein these screen cylinders have means arranged so as to print areas lying between the already printed areas, the machine being designed so that each of the screen cylinders does not come into contact with the impression cylinder on the previously printed areas.

11. A screen printing machine comprising, for printing at least one first area in a defined color, an impression cylinder (6) and a screen cylinder (7) and at least one second screen cylinder (8; 48; 48'), interacting with the same impression cylinder (6) and being provided with means **(51*a*; 51'*a*) for printing at least one second area in a different color from that of the first area, wherein the machine is organized so that the said second area is outside the first area, the second screen cylinder (48; 48') for printing a second area comprising an elastically deformable screen (49; 49') and means (51; 51') pushing the screen and the ink radially outward only over areas to be printed in order to bring the screen (49) into contact with the impression cylinder (6) over said areas, wherein the means pushing the screen (49') radially outward is a squeegee (51') in the shape of a comb whose teeth (51'*a*) correspond to the areas to be printed, and between two consecutive areas to be printed the screen is provided with at least one ring (55)** which prevents the screen from deforming and from contacting the impression cylinder.

12. The machine as claimed in claim 11, wherein the screen (49') includes two rings (55) delimiting each area which has not to come into contact with the impression cylinder.

13. The machine as claimed in claim 11, wherein said at least one ring (55) is arranged outside the screen (49').

* * * * *